US009597911B2

(12) United States Patent
Yoda et al.

(10) Patent No.: US 9,597,911 B2
(45) Date of Patent: Mar. 21, 2017

(54) INTERMEDIATE TRANSFER MEDIUM

(71) Applicant: DAI NIPPON PRINTING CO, LTD., Tokyo (JP)

(72) Inventors: Shinya Yoda, Tokyo (JP); Tadahiro Ishida, Tokyo (JP); Mitsuhiro Oota, Tokyo (JP)

(73) Assignee: DAI NIPPON PRINTING CO., LTD., Tokyo (JP)

( * ) Notice: Subject to any disclaimer, the term of this patent is extended or adjusted under 35 U.S.C. 154(b) by 39 days.

(21) Appl. No.: 14/586,304

(22) Filed: Dec. 30, 2014

(65) Prior Publication Data

US 2015/0118420 A1 Apr. 30, 2015

Related U.S. Application Data

(62) Division of application No. 13/819,737, filed as application No. PCT/JP2011/068938 on Aug. 23, 2011, now Pat. No. 8,962,112.

(30) Foreign Application Priority Data

Aug. 31, 2010 (JP) ..... 2010-195080
Aug. 31, 2010 (JP) ..... 2010-195083
(Continued)

(51) Int. Cl.
*B41M 5/382* (2006.01)
*B41M 5/42* (2006.01)
(Continued)

(52) U.S. Cl.
CPC ..... *B41M 5/44* (2013.01); *B41M 5/38257* (2013.01); *B41M 5/50* (2013.01);
(Continued)

(58) Field of Classification Search
CPC .... B41M 5/382; B41M 5/38257; B41M 5/42; B41M 5/44; B41M 2205/02; B41M 2205/06; B41M 2205/10; B41M 2205/40
(Continued)

(56) References Cited

U.S. PATENT DOCUMENTS 5,634,731 A * 6/1997 Kita ..... B41J 2/325 347/213

FOREIGN PATENT DOCUMENTS

JP 62-238791 10/1987
JP 7-156567 6/1995
(Continued)

*Primary Examiner* — Bruce H Hess
(74) *Attorney, Agent, or Firm* — Young & Thompson

(57) ABSTRACT

In an intermediate transfer medium, a substrate, protective layers having a layered structure of two or more layers, and a receiving layer are layered in this order. One layer in the protective layers having the layered structure contains, as a main component, one material or a mixture of two or more materials selected from the group consisting of polyesters having a high polymerization degree, a number-average molecular weight (Mn) of not less than 12,000 and a Tg of not less than 60° C., polycarbonates and polyester urethanes. Another layer in the protective layers having the layered structure contains one or more materials selected from the group consisting of polyvinyl alcohols, polyvinyl butyrals, polyvinyl acetals and polyvinyl pyrrolidones or includes a cationic resin, and the receiving layer contains a side chain-type aralkyl-modified silicone in an amount of 0.5-5% by weight on a base of the total weight of the receiving layer.

1 Claim, 1 Drawing Sheet

(30) Foreign Application Priority Data

Sep. 29, 2010 (JP) ..... 2010-219731
Aug. 5, 2011 (JP) ..... 2011-172334

(51) Int. Cl.
*B41M 5/44* (2006.01)
*B41M 5/50* (2006.01)
*B41M 5/52* (2006.01)
*B41M 7/00* (2006.01)

(52) U.S. Cl.
CPC ..... *B41M 5/529* (2013.01); *B41M 5/5272* (2013.01); *B41M 7/0027* (2013.01); *B41M 2205/10* (2013.01); *B41M 2205/40* (2013.01)

(58) Field of Classification Search
USPC ..... 503/227; 428/32.51
See application file for complete search history.

(56) References Cited

FOREIGN PATENT DOCUMENTS

| | | |
|---|---|---|
| JP | 2000-177282 | 6/2000 |
| JP | 2002-036795 | 2/2002 |
| JP | 2002-222516 | 8/2002 |
| JP | 2004-351656 | 12/2004 |
| JP | 2005-074821 | 3/2005 |
| JP | 2005-178098 | 7/2005 |
| JP | 2009-241587 | 10/2009 |
| JP | 2010-046919 | 3/2010 |

* cited by examiner

INTERMEDIATE TRANSFER MEDIUM

TECHNICAL FIELD

The present invention relates to an intermediate transfer medium.

BACKGROUND ART

Conventionally, thermal transfer method has been widely used as a simple printing method. Melt-transfer printing system which is one of the thermal transfer methods is an image forming method wherein a thermal transfer sheet which has a thermally fusible ink layer comprising a colorant such as a pigment, and a binder such as a thermally fusible wax or resin is superposed on a thermal transfer image-receiving sheet such as a plastic sheet or paper, and then an energy in accordance with image information is applied to the thermal transfer sheet by a heating means such as a thermal head from the back side of the thermal transfer sheet, and thereby the colorant is transferred onto the thermal transfer image-receiving sheet together with the binder. The image formed by the melt-transfer printing system is suitable for recording binary images such as characters, since the image has excellent sharpness and high concentration.

The sublimation transfer method which is one of the thermal transfer method heat is another image forming method wherein a thermal transfer sheet which has a dye layer comprising a subliming dye which is able to be transferred thermally by sublimation is superposed on a thermal transfer image-receiving sheet wherein a dye-receiving layer is provided on a substrate sheet, and then an energy in accordance with image information is applied to the thermal transfer sheet by a heating means such as a thermal head from the back side of the thermal transfer sheet, and thereby the subliming dye is transferred onto the thermal transfer image-receiving sheet. With respect to the sublimation transfer method, since the transferring amount of dye can be controlled by the amount of energy applied, it is possible to form a gray-scale image in which image density of every dot of the thermal head is controlled. In addition, since the colorants used are dyes, the image formed has transparency. Thus, when dyes of different colors are superposed, the reproducibility of neutral tints becomes excellent. Therefore, when using thermal transfer sheets of different colors such as yellow, magenta, cyan, black or the like, and transferring dye of each color on the thermal transfer image-receiving sheet so as to superpose the dyes each other, it is possible to form a photographic full-color image of high quality in which reproducibility of neutral tints is excellent.

Along by the development of various hardware and software related to multimedia, this thermal transferring method have been expanding its market as a full-color hard copy system for digital images represented by computer graphics, satellite static images, CD-ROM or the like, and for analog images such as video. The thermal transfer image-receiving sheet according to the thermal transfer method includes a wide range of concrete applications. As typical examples, proof printing; image output; output of plan or design, such as those drawn by CAD/CAM, etc.; output use for various medical analytical or measuring instruments such as CT scan, endoscopic camera, etc.; and a substitute for instant photos; as well as, output of picture of face to an identification paper or ID card, credit card, or other cards; and applications as composite photograph or souvenir picture at an amusement facilities such as amusement park, amusement arcade, museum, and aquarium, etc., can be mentioned.

With the diversification of use of the above-mentioned thermal transfer image-receiving sheet, there is an increasing demand for forming a thermal transfer image on an arbitrary object. As the object for forming the thermal transfer image, a purpose-built thermal transfer image-receiving sheet which is provided with a receiving layer on the substrate is usually utilized. However, in this case, the substrate or the like subjects to some type of constraints. Under these circumstances, Patent literature 1 discloses an intermediate transfer medium in which the receiving layer is provided on the substrate so that the receiving layer can be peeled off from the substrate. According to the intermediate transfer medium, by transferring the dye of the dye layer to the receiving layer so as to form an image, and then heating the intermediate transfer medium, it is possible to transfer the receiving layer onto which the dye has been transferred to an arbitrary transcription receiving article. Thus, it becomes possible to form a thermal transfer image without concern for the constraints about the kind of transcription receiving article.

On the other hand, the thermal transfer image, which is formed by using the intermediate transfer medium mentioned above, suffers with a problem of lack of durability including weather resistance, abrasion resistance, chemical resistance, etc., since the receiving layer onto which an image is formed is positioned on the outermost surface. Then, recently, as shown in Patent literature 2, an intermediate transfer medium in which a release layer, a protective layer, and a layer functioned both as receiving layer and adhesive layer is provided on a substrate has been proposed. According to the intermediate transfer medium, since the protective layer is formed on the surface of the thermal transfer image, it is possible to impart durability to the thermal transfer image. In the case that the protective layer does not have an enough durability to a plasticizer (hereinafter, referred to as "plasticizer resistance".), however, when the protective layer after transferred to the transcription receiving article comes in contact with a resin which contains a plasticizer, for example, when the protective layer come in contact with vinyl chloride-vinyl acetate copolymer, a phenomenon in which the plasticizer migrated to the receiving layer, on which the image had been formed, by passing through the protective layer occurred. As the result, problems, such as blurring of the image, and disappearance of the image, was caused. Under these circumstances, in Patent literature 3, a protective layer transfer sheet which is provided with a protective layer which is mainly composed of acrylic resin that has a sufficient plasticizer resistance has been proposed. The protective layer mainly composed of acrylic resin is formed by dissolving or dispersing the acrylic resin in a suitable solvent in order to prepare a coating liquid for the protective layer, and coating the coating liquid and drying it.

PRIOR ART LITERATURE

Patent Literature

Patent literature 1: JP SHO 62-238791 A
Patent literature 2: JP 2004-351656 A
Patent literature 3: JP HEI 7-156567 A

SUMMARY OF THE INVENTION

Problems to be Solved by the Invention

However, since the coating liquid for the protective layer comprising an acrylic resin is of inferior stability of coat film, the coat film suffers from cracks when coating and drying the coating liquid for the protective layer. In addition, the problem that the protective layer which is finally formed also suffers from cracks arises. In particular, with respect to the intermediate transfer medium, since it is necessary to form a receiving layer on the protective layer, the cracking in the protective layer causes a decline in image quality as a result. In addition, as for the protective layer, the desire to have a plasticizer resistance higher than the acrylic resin has grown, and the plasticizer resistance of the protective layer is left room for further improvement.

In addition, the durability of the protective layer of the intermediate transfer medium, which is proposed in Patent literature 2, have not reached the stage to satisfy demands in the fields where a particularly high durability is required, such as the field of identification paper, ID card, credit card, etc. Therefore, in order to ensure the demands in such fields, it has been adopted a way of putting a PET film, generally described as "PET patch", on the formed image so as to satisfy the demands of durability. However, this way is not preferable in view of the process, because an additional printer is required.

Further, as the receiving layer of the intermediate transfer medium, a resin having a good adhesion, for instance, styrene resin having a softening point of not less than 100° C., epoxy resin, acrylic resin or the like is used in consideration of the adhesion (hereinafter, it is also referred to as "adhesiveness" occasionally.) to the transcription receiving article, as proposed in Patent literature 2. However, when the receiving layer which is mainly composed of such a resin having a high adhesion is used, the release property of the receiving layer from the thermal transfer sheet becomes worse in response to the increment of adhesion. Thus, when a thermal transfer image is formed on the receiving layer by using the thermal transfer sheet, thermal fusion will occur between the receiving layer and the thermal transfer sheet, i.e., between the receiving sheet and the dye layer of the thermal transfer sheet, which is followed by an inferior result that the components of the receiving sheet are lost by transferring them to the dye layer side of the thermal transfer sheet.

That is, in the field of the intermediate transfer medium, it is desired that the receiving layer should fully satisfy both of the release property capable of being released from the thermal transfer sheet and the adhesion property capable of adhering to the transcription receiving article. However, there is a trade-off relationship between the release property and the adhesion property, and there is no intermediate transfer medium which has a receiving layer which fulfills both the adhesion property and the release property up to the present.

The present invention has been made in view of the above-mentioned circumstances, and the present invention aims principally to provide an intermediate transfer medium of at least one of the following (i)-(iii):

(i) to provide an intermediate transfer medium which excels in the stability of coat film and the plasticizer resistance; (ii) to provide an intermediate transfer medium which can easily prepare a printed matter of high durability; (iii) to provide an intermediate transfer medium which excels in the release property from the thermal transfer sheet and the adhesive property to the transcription receiving article.

Means for Solving the Problems

The present invention for solving the above-mentioned problems is an intermediate transfer medium which comprises a substrate, protective layers which have a layered structure comprising two or more of layers, and a receiving layer; wherein these are layered in that order; and which is characterized by the fact that one protective layer in the protective layers having the layered structure is a durable layer which mainly comprises one member or a mixture of two or more members selected from the group consisting of polyester of high polymerization degree which has a number average molecular weight (Mn) of not less than 12,000 and Tg of not lower than 60° C., polycarbonate, and polyester urethane; another protective layer in the protective layers having the layered structure is a plasticizer-resistive layer which comprises one or more members selected from the group consisting of polyvinyl alcohol, polyvinyl butyral, polyvinyl acetal, polyvinyl pyrrolidone, or comprises a cationic resin; and the receiving layer contains a side-chain type aralkyl-modified silicone in a proportion of from 0.5 to 5% by weight on a base of the total weight of the receiving layer.

Further, the protective layers having the layered structure may comprises the plasticizer-resistive layer and the durable layer, which are layered in that order from the substrate side.

In addition, an exfoliate layer may be provided between the substrate and the protective layers having the layered structure.

The present invention for solving the above-mentioned problems is an intermediate transfer medium which comprises a substrate, and at least a protective layer and a receiving layer which are layered in that order on one surface side of the substrate; and which is characterized by the fact that the protective layer comprises one or more members selected from the group consisting of polyvinyl alcohol, polyvinyl butyral, polyvinyl acetal, polyvinyl pyrrolidone, or comprises a cationic resin.

In addition, the polyvinyl alcohol, the polyvinyl butyral, and the polyvinyl acetal may have a saponification degree in the range of 30-100%.

The present invention for solving the above-mentioned problems is an intermediate transfer medium which comprises a substrate, and at least a protective layer and a receiving layer which are layered in that order on one surface side of the substrate; and which is characterized by the fact that the protective layer mainly comprises one member or a mixture of two or more members selected from the group consisting of polyester of high polymerization degree which has a number average molecular weight (Mn) of not less than 12,000 and Tg of not lower than 60° C., polycarbonate, and polyester urethane.

The present invention for solving the above-mentioned problems is an intermediate transfer medium which comprises a substrate, and at least a protective layer and a receiving layer which are layered in that order on one surface side of the substrate; and which is characterized by the fact that the receiving layer contains a side-chain type aralkyl-modified silicone in a proportion of from 0.5 to 5% by weight on a base of the total weight of the receiving layer.

In addition, a side-chain type epoxy-modified silicone may be further contained in a proportion of from 0.5 to 5% by weight on a base of the total weight of the receiving layer.

Effects of the Invention

According to the present invention, it is possible to provide any one of (i) an intermediate transfer medium which excels in the stability of coat film and the plasticizer resistance; (ii) an intermediate transfer medium which can easily prepare a printed matter of high durability; and (iii) an intermediate transfer medium which excels in the release property from the thermal transfer sheet and the adhesive property to the transcription receiving article.

MODE FOR CARRYING OUT THE INVENTION

First Aspect of the Present Invention

Figure 1:
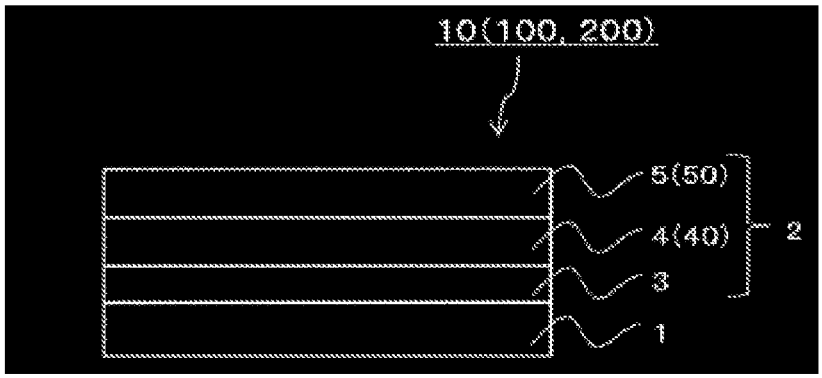
FIG. 1 is a schematic sectional view which illustrate a layered construction of the intermediate transfer medium according to the present invention.

Now, the intermediate transfer medium 10 according to a first aspect of the present invention will be described below in detail with reference to the drawings. As shown in FIG. 1, the intermediate transfer medium 10 according to the first aspect comprises a substrate 1, and a protective layer 4 and a receiving layer 5 which are formed on one surface side of the substrate 1 (the upper side surface of the substrate 1 in the case shown in FIG. 1). In addition, a transfer layer 2 which includes the protective layer 4 and the receiving layer 5 takes a configuration which is transferred to a transcription receiving article at the time of thermal transfer. As far as this aspect satisfies the above-mentioned requirement, this aspect is not restricted by any further limitations, and the intermediate transfer medium 10 may be provided with other layer(s) such as an exfoliate layer 3, a release layer, an adhesive layer, etc., if necessary.

Then, this aspect of the present invention is characterized by the fact that the protective layer comprises one or more members selected from the group consisting of polyvinyl alcohol, polyvinyl butyral, polyvinyl acetal, polyvinyl pyrrolidone, or comprises a cationic resin. Will be described below in more detail for the first aspect of the present invention. The first aspect of the present invention will be described more concretely below.

(Substrate)

The substrate 1 is essential constituent of the intermediate transfer medium 10 of the present invention, and is provided to hold the protective layer 4. There is no particular limitation on the substrate 1, and as the substrate, unstretched or stretched plastic films, for instance, polyesters having high heat resistance such as polyethylene terephthalate and polyethylene naphthalate; polypropylene; polycarbonate; cellulose acetate; polyethylene derivatives; polyamides, and polymethylpentene, etc., can be exemplified. Composite films obtained by laminating two or more of these materials can be also used. The thickness of the substrate 1 may be appropriately selected depending on the kind of the material used, so that the strength, heat resistance and the like of the substrate lie in appropriate ranges. Usually, about 1-100 μm in thickness is preferably used.

(Transfer Layer)

As shown in FIG. 1, on the substrate 1, the transfer layer 2 is formed so that it is able to be separated from the substrate 1 at the time of heat transfer. This transfer layer 2 comprises at least the protective layer 4 and the receiving layer 5, both of which are essential constituents of the intermediate transfer medium 10 of the present invention. The transfer layer 2 is exfoliated from the substrate and is transferred to a transcription receiving article during the thermal transfer.

(Exfoliate Layer)

As shown in the drawing, it is possible to provide an exfoliate layer 3 between the substrate 1 and the protective layer 4, optionally, in order to improve the exfoliation of the transfer layer 2 from the substrate 2. This exfoliate layer 3 is an optional constituent of the transfer layer 2, and it is transferred onto the transcription receiving article at the thermal transfer.

There is no particular limitation for the exfoliate layer 3, and it may be appropriately selected and used from conventionally known materials. Usually, it may be formed by using a thermoplastic resin which includes cellulose derivatives such as ethyl cellulose, nitro cellulose, and cellulose acetate, acrylic resins such as polymethyl methacrylate, polyethyl methacrylate, polybutyl metacrylate, a polyvinyl chloride or a vinyl copolymers such as vinyl chloride-vinyl acetate copolymer, and polyvinyl butyral; or a thermosetting resin which includes saturated or unsaturated polyester resins, polyurethane resins, thermally cross-linkable epoxy-amino resins, and amino alkyd resins; or silicone wax, silicone resin, modified silicone resin, fluorine resin, modified fluorine resins, or polyvinyl alcohol. Further, in order to improve the filmy exfoliation ability of the exfoliate layer 3, it is preferable that the exfoliate layer contains a filler such as micro-silica and polyethylene wax. Herein, the exfoliate layer 3 may be made of one kind of resin, or may be made of two or more kinds of resins. The exfoliate layer 3 may be formed by using a cross-linking agent such as isocyanate, a catalyst such as tin-based catalyst, aluminum-based catalyst, in addition to the resin(s) mentioned above.

In accordance with a known coating procedure such as roll coating, gravure coating, and bar coating, the exfoliate layer 3 may be formed by coating a coating liquid, which has prepared by dispersing or dissolving the above-mentioned resin into a solvent in advance, onto at least a part of the surface of the substrate 1, and drying it. As the thickness of the exfoliate layer 3, it may be generally in the range of about 0.1 μm-5 μm, and preferably in the range of about 0.5 μm-2 μm.

(Protective Layer of the First Aspect)

The protective layer 4 is provided for the purpose of imparting plasticizer resistance to a printed matter which is formed by transferring the transfer layer 2 onto the transcription receiving article. In the present invention, upon forming a protective layer to achieve the above-mentioned function, (1) a substance which repels the plasticizer component, or (2) a substance which gives the plasticizer component difficulties in reaching the printed image are selected as a substance which is contained in the protective layer 4. According to the substance (1) selected in the present invention, it is possible to give the plasticizer resistance to the protective layer 4, since the protective layer repels the plasticizer component. According to the substance (2) selected in the present invention, it is possible to give the plasticizer resistance to the protective layer 4, as a result of the fact that the plasticizer component can hardly reach the printed image.

That is, when the protective layer is formed by using a material which satisfies either the characteristic (1) or the characteristic (2), it becomes possible to impart the plasticizer resistance to the protective layer entirely, in either case. First, the above-mentioned substance (1) which repels the plasticizer component will be explained below.

In the present invention, as the above-mentioned substance (1) which repels the plasticizer component, one or more members selected from the group consisting of polyvinyl alcohol, polyvinyl butyral, polyvinyl acetal, polyvinyl pyrrolidone are provided.

According to the protective layer 4 containing the substance (1) above, the plasticizer resistance is given to the protective layer 4, because of the presence of the substance (1) which repels the plasticizer. Thus, it become possible to improve the plasticizer resistance of the protective layer. Thus, even when the protective layer 4 happens to come in contact with a resin having a plasticizer, for instance, polyvinyl chloride-vinyl acetate copolymer, the migration of plasticizer ingredient from the resin to the image formed on the receiving layer is prohibited.

Specific mechanisms on the improvement in the plasticizer resistance of the protective layer when adding one or more members selected from the group consisting of polyvinyl alcohol, polyvinyl butyral, polyvinyl acetal, polyvinyl pyrrolidone, which belong in the above-mentioned substance (1) have not been fully elucidated. At present, it is assumably considered that the plasticizer resistance is improved because polyvinyl alcohol, polyvinyl butyral, and polyvinyl acetal have hydrogen oxide groups in their respective structures, and the hydrogen oxide groups repels the plasticizer component. On the other hand, with respect to polyvinylpyrrolidone, it is assumed that oxygen groups existed in heterocyclic rings of the polyvinylpyrrolidone may have a property of repelling the plasticizer component in a similar fashion to the above mentioned hydrogen oxide groups, or the oxygen groups may form hydrogen oxide-like structures with their respectively neighboring hydrogen groups, and thereby, the plasticizer resistance is improved.

In addition, with respect to polyvinyl alcohol, polyvinyl butyral, and polyvinyl acetal, it is preferable to have a saponification degree in the range of 30-100%, and more desirably, to have a saponification degree in the range of 60-100%. When the polyvinyl alcohol, polyvinyl butyral, or polyvinyl acetal, which has a saponification degree in the above-mentioned range, is contained in the protective layer 4, it can be expected to improve further the plasticizer resistance. Herein, the "saponification degree" used in the present invention refers to the value obtained by dividing the number of moles of vinyl alcohol structures in the polymer by the number of moles of all monomers in the polymer.

Further, it is preferable that one member or a mixture of two or more members selected from the group consisting of polyvinyl alcohol, polyvinyl butyral, polyvinyl acetal, polyvinyl pyrrolidoneone, that belong to the above mentioned substance (1) is contained in the protective layer 4 so that the weight of the member (in the case of two or more members are used, the weight of the mixture) is in the range of 20-100% by weight on a base of the total weight of the protective layer 4.

Next, the above-mentioned substance (2) which gives the plasticizer component difficulties in reaching the printed image will be explained below. In the present invention, as the above-mentioned substance (2) which gives the plasticizer component difficulties in reaching the printed image, cationic resin is provided.

The cationic resin used in the present invention is a resin having cationic property, and in the present invention, for example, it is possible to use a cationic urethane emulsion.

As is the case with the above-mentioned substance (1), specific mechanisms on the improvement in the plasticizer resistance of the protective layer when adding the cationic resin which is the substance (2) have not been fully elucidated. At present, it is assumed that the plasticizer component is forced to be hardly to reach the printed image formed on the receiving layer, since an electrical attraction will occur between the cationic part of the cationic resin and conjugate electrons of the plasticizer component, and thereby the cationic resin and the plasticizer component attracts each other electrically. Alternatively, it is also assumed that the plasticizer component is forced to be hardly to reach the printed image formed on the receiving layer, since electrons in covalent bonds or in conjugated bonds of the plasticizer component are reacted with cations of the cationic resin, and thus, the protective layer 4 is coupled with the plasticizer component and the surface of the protective layer causes a certain structural change which inhibits the invasion of the plasticizer component into the protective layer.

In addition, with respect to the cationic resin, it is preferable that it is contained in the protective layer 4 so that the weight thereof is in the range of 20-100% by weight on a base of the total weight of the protective layer 4.

Alternatively, the above-mentioned substance (1) and the above-mentioned substances (2) may be used in combination. Concretely, one member or a mixture of two or more members selected from the group consisting of polyvinyl alcohol, polyvinyl butyral, polyvinyl acetal, polyvinyl pyrrolidone, as well as a cationic resin, may be contained in the protective layer 4. When the substance which repels the plasticizer component and the substance which is able to couple with the plasticizer component are used in combination, it becomes possible to improve the plasticizer resistance more effectively. In this case, it is preferable that the total weight of the total weight of the substance (s) (1) and the weight of the substance (2) are in the range of 20-100% by weight on a base of the total weight of the protective layer 4.

In addition, since the protective layer 4 which comprises one or more members selected from the group consisting of polyvinyl alcohol, polyvinyl butyral, polyvinyl acetal, polyvinyl pyrrolidone, which each belongs to the above-mentioned substance (1), or comprises a cationic resin which belongs to the above-mentioned substance (2) excels in film-formability and the film thus is tough, the stability of coated film with respect to the protective layer 4 thus formed is also excellent. More specifically, when a coated film of the protective layer 4 is formed by dissolving or dispersing one or more members selected from the group consisting of the above-mentioned substances (1), or a member of the above-mentioned substances (2) in an appropriate solvent in order to prepare a coating liquid for protective layer, coating the coating liquid onto the exfoliate layer 3, and drying it, no cracking or other defects will appear in the coated film. In this way, it is possible to form a protective layer 4 which enjoys a high stability of the coated film.

Further, if necessary, it is possible to add to the protective layer 4, any additives, for example, lubricants, plasticizers, fillers, antistatic agents, anti-blocking agents, cross-linking agents, antioxidants, UV absorbers, light stabilizers, colorants such as dyes and pigments, fluorescent whitening agents, etc. As the method for forming the protective layer 4, such a procedure in which one or more members selected from the group consisting of polyvinyl alcohol, polyvinyl butyral, polyvinyl acetal, polyvinyl pyrrolidone, or a cationic resin is dissolved or dispersed in an appropriate solvent in order to prepare a coating liquid for protective layer, and the coating liquid thus prepared is coated on the substrate 1, or on the exfoliate layer 3 which is optionally provided, in accordance with a known procedure such as gravure printing method, screen printing method, or reverse-coating method using a gravure plate, etc., and then the coated film is dried, may be applicable. Although there is no particular limitation on the thickness of the protective layer 4, the protective layer 4 is usually about 0.1-50 μm in thickness after drying, and preferably, about 1-20 μm in thickness after drying. Further, when one or more members selected from the group consisting of polyvinyl alcohol, polyvinyl butyral, polyvinyl acetal, polyvinyl pyrrolidone, or a cationic resin is dissolved or dispersed in an aqueous solvent so as to prepare an aqueous coating liquid, it is possible to form a protective layer without deteriorating the properties of other layers, and thus such a procedure is preferable.

(Receiving Layer)

As shown in FIG. 1, on the protective layer 4, a receiving layer 5 which constitutes the transfer layer 2 is provided. On the receiving layer, an image will be formed by thermal transfer from a thermal transfer sheet having a coloring agent layer in accordance with the thermal transfer method. Then, the transfer layer 2 of the intermediate transfer medium, on which the image have been thus formed, is transferred onto a transcription receiving article. As a result, a printed matter is produced. Therefore, as a material for forming the receiving layer 5, it is possible to adopt any resin material which is known as the one that can easily receive thermally-transferable colorants such as subliming dyes or thermally-fusible inks. For example, polyolefin resins such as polypropylene; halogenated resins such as polyvinyl chloride and polyvinylidene chloride; vinyl resins such as polyvinyl acetate, vinyl chloride-vinyl acetate copolymer, ethylene-vinyl acetate copolymer and polyacrylic ester; polyester resins such as polyethylene terephthalate and polybutylene terephthalate; polystyrene resins; polyamide resins; copolymer type resins of an olefin such as ethylene or propylene and another vinyl polymer; ionomer or cellulose-based resins such as cellulose diastase; polycarbonate; etc., are exemplified. In particular, vinyl chloride resin, acryl-styrene resin or a polyester resin is preferred.

Alternatively, it is also possible to use a receiving layer 50 as-is, which constitutes the intermediate transfer medium according to a third aspect of the present invention other than this. See below for details on the receiving layer 50.

When the receiving layer 5 is transferred to the transcription receiving article via an adhesive layer, adhesiveness for the receiving layer 5 itself is not necessarily required. However, if the receiving layer 5 is transferred to the transcription receiving article without the adhesive layer, it is preferable that the receiving layer 5 comprises a resin material having adhesive property, such as a vinyl chloride-vinyl acetate copolymer.

The receiving layer 5 can be formed by dissolving or dispersing a material or plural materials selected from the above-mentioned materials, and optionally in combination with various additives, into an appropriate solvent such as water or an organic solvent in order to prepare a coating liquid for the receiving layer, coating thus prepared coating liquid for the receiving layer in accordance with a known procedure such as gravure printing method, screen printing method, or reverse-coating method using a gravure plate, etc., and then drying the coated film. The receiving layer 5 is usually about 1-10 μm in thickness in dried state.

(Transcription Receiving Article)

Onto the transcription receiving article, the transfer layer 2 of the above-mentioned intermediate transfer medium, in which the thermal transfer image has been formed, is transferred. As a result, it is possible to obtain a printed matter which excels in various durability. As the transcription receiving article to which the intermediate transfer medium according to the present invention can be applied, there is no particular limitation, and for instance, any of vinyl chloride-vinyl acetate copolymer, polyethylene terephthalate (PET), polycarbonate, natural fiber paper, coated paper, tracing paper, glass, metal, ceramics, wood, cloth, and so on, may be utilized.

Second Aspect of the Present Invention

Next, an intermediate transfer medium 100 according to a second aspect of the present invention will be described. As in the case of the above-mentioned first aspect, the intermediate transfer medium 100 according to the second aspect comprises a substrate 1, and a protective layer 40 and a receiving layer 5 which are formed on one surface side of the substrate 1 (the upper side surface of the substrate 1 in the case shown in FIG. 1). A transfer layer 2 which includes the protective layer 40 and the receiving layer 5 as essential constituents is transferred to a transcription receiving article at the time of thermal transfer.

Here, the intermediate transfer medium 100 according to the second aspect of the present invention is characterized by the fact that it is provided with the protective layer 40 which mainly comprises one member or a mixture of two or more members selected from the group consisting of (i) polyester of high polymerization degree which has a number average molecular weight (Mn) of not less than 12,000 and Tg of not lower than ° C., (ii) polycarbonate, and (iii) polyester urethane, instead of the above-mentioned protective layer 4 described in the first aspect of the present invention. The second aspect of the present invention will be described more concretely below. The number average molecular weight (Mn) used herein denotes a number average molecular weight measured by GPC in terms of polystyrene standard.

(Protective Layer of the Second Aspect)

The protective layer 40 mainly comprises one member or a mixture of two or more members selected from the group consisting of (i) polyester of high polymerization degree which has a number average molecular weight (Mn) of not less than 12,000 and Tg of not lower than 60° C., (ii) polycarbonate, and (iii) polyester urethane. Thereby, a particularly excellent durability is given to the protective layer 40. Incidentally, if a polyester of high polymerization degree which has a number average molecular weight (Mn) of less than 12,000 or the one which has a Tg of lower than 60° C. is used, the durability will deteriorate notably. The polyester urethane used herein denotes a copolymer of polyester and polyurethane.

Particularly, when the polyester of high polymerization degree which has a number average molecular weight (Mn) of not less than 12,000 and Tg of not lower than 60° C. is used, it is hard to cause blooming upon the transfer. Therefore, in the field where it is necessary to prevent the occurrence of blooming, the polyester of high polymerization degree can be used suitably as a main ingredient of the protective layer 40. When one or both of the polycarbonate and the polyester urethane are used in combination with the polyester of high polymerization degree which has a number average molecular weight (Mn) of not less than 12,000 and Tg of not lower than ° C., it is preferable that the polyester of high polymerization degree which has a number average molecular weight (Mn) of not less than 12,000 and Tg of not lower than 60° C. is contained in an amount of not less than 50% by weight on a base of the total weight of the mixture. Incidentally, when focusing only on the durability simply, even when any one of the polyester of high polymerization degree which has a number average molecular weight (Mn) of not less than 12,000 and Tg of not lower than 60° C., the polycarbonate, and the polyester urethane is used, the functions and effects of the present invention can be achieved.

Further, as far as one member or a mixture of two or more members selected from the group consisting of the polyester of high polymerization degree which has a number average molecular weight (Mn) of not less than 12,000 and Tg of not lower than 60° C., the polycarbonate, and the polyester urethane contains mainly in the protective layer 40, the content of the one member or a mixture of two or more members is not particularly limited. However, it is necessary to be contained in an amount of not less than 50% by weight on a base of the total weight of the protective layer 40, and more particularly, to be contained in an amount of not less than 50% by weight and not more than 100% by weight on a base of the total weight of the protective layer.

There is no particular limitation on the thickness of the protective layer 40. When the thickness of the protective layer 40 is less than 2 μm, however, a tendency that the durability becomes lower may arise. On the other hand, when the thickness of the protective layer 40 is thicker than 15 μm, the definition property of the protective layer becomes lower, which may be followed by an occurrence of blooming, etc., upon the thermal transfer of the transfer layer to the transcription receiving article. Considering these points, it is preferable that the thickness of the protective layer 40 is in the range of not less than 2 μm and not more than 15 μm.

(Other Materials)

In addition, the protective layer 40 may be also contain other materials, such as fluorescent whitening agent, UV absorber to improve a weather resistance better, etc., in addition to the above-mentioned materials as the main components.

As the method for forming the protective layer 40, such a procedure in which one member or a mixture of two or more members selected from the group consisting of the polyester of high polymerization degree which has a number average molecular weight (Mn) of not less than 12,000 and Tg of not lower than ° C., the polycarbonate, and the polyester urethane is dissolved or dispersed in an appropriate solvent in order to prepare a coating liquid for protective layer, and the coating liquid thus prepared is coated on the substrate 1, or on the exfoliate layer 3 which is optionally provided, in accordance with a known procedure such as gravure printing method, screen printing method, or reverse-coating method using a gravure plate, etc., and then the coated film is dried, may be applicable.

(Exfoliate Layer)

In order to improve the exfoliation of the transfer layer 2 from the substrate 1, as is in the case of the first aspect of the present invention, it is possible to provide an exfoliate layer 3 between the substrate 1 and the protective layer 40, optionally. When as the main component of the protective layer 40 the polyester of high polymerization degree which has a number average molecular weight (Mn) of not less than 12,000 and Tg of not lower than 60° C. is employed, it is preferable to form the exfoliate layer 3 between the substrate 1 and the protective layer 40, because the polyester of high polymerization degree shows a high adhesiveness to the substrate 1. On the other hand, in the case that the polycarbonate is employed as a main component of the protective layer 40, the transfer layer 2 can be easily peeled off from the substrate even if the intermediate transfer medium does not have the exfoliate layer 3, because the polycarbonate excels in the releasing ability to the substrate 1. As the exfoliate layer 3 which is optionally provided, the one that is described above in relation with the first aspect of the present invention can be used as-is, and thus, the explanation thereof is omitted here. In addition, as the substrate 1 and the receiving layer 5, those which are described above in relation with the first aspect of the present invention can be used as-is. Further, instead of the receiving layer 5, it is possible to use a receiving layer 50 as-is, the receiving layer constituting the intermediate transfer medium according to the third aspect of the present invention. See below for details on the receiving layer 50.

Third Aspect of the Present Invention

Next, the intermediate transfer medium according to the third aspect of the present invention will be described. As in the case of the above-mentioned first aspect and the above-mentioned second aspect, the intermediate transfer medium 200 according to the third aspect of the present invention comprises a substrate 1, and a protective layer 4, 40 and a receiving layer 50 which are formed on one surface side of the substrate 1 (the upper side surface of the substrate 1 in the case shown in FIG. 1).

Herein, the third invention is characterized in that the receiving layer 50 contains a side-chain type aralkyl-modified silicone in a proportion of from 0.5 to 5% by weight on a base of the total weight of the receiving layer 50. The third aspect of the present invention will be described more concretely below.

(Transfer Layer)

As shown in FIG. 1, on the substrate 1, the transfer layer 2 is formed so that it is able to be separated from the substrate 1 at the time of heat transfer. This transfer layer 2 comprises at least the protective layer 4, 40 or a protective layer known in the art, and the receiving layer 50, both of which are essential constituents of the intermediate transfer medium. 200 of the present invention (in the case shown in FIG. 1, the transfer layer 2 is composed of the exfoliate layer 3, the protective layer 4, and the receiving layer 50). The transfer layer 2 is exfoliated from the substrate and is transferred to a transcription receiving article during the thermal transfer.

(Exfoliate Layer)

As in the case of the above-mentioned first aspect and the above-mentioned second aspect, it is possible to provide an exfoliate layer 3 between the substrate 1 and the protective layer. As the exfoliate layer 3, the one that is described above in relation with the first aspect of the present invention can be used as-is, and thus, the explanation thereof is omitted here. This respect is also similar to the substrate 1.

The protective layer 4, is an essential constituent in the intermediate transfer medium according to the third aspect of the present invention. As the protective layer 4, it is possible to use the protective layer 4 as described in the first aspect of the present invention, namely, the protective layer 4 which comprises one or more members selected from the group consisting of polyvinyl alcohol, polyvinyl butyral, polyvinyl acetal, polyvinyl pyrrolidone, or comprises a cationic resin, as-is. Instead of using the protective layer 4, it is also possible to use the protective layer 40, as described in the second aspect of the present invention, namely, the protective layer 40 mainly comprises one member or a mixture of two or more members selected from the group consisting of polyester of high polymerization degree which has a number average molecular weight (Mn) of not less than 12,000 and Tg of not lower than ° C., polycarbonate, and polyester urethane, as-is. Alternatively, instead of using the protective layer 4 or 40, it is also possible to use a protective layer which is known in the art.

As the protective layer known in the art, for example, polyester resins, acrylic resins, ultraviolet absorbing resins, epoxy resins, polystyrene resins, polyurethane resins, acryl urethane resins; and silicone-modified resins of the above mentioned resins; any mixtures of the above mentioned resins; ionizing radiation curable resins; and, ultraviolet absorbing resins; or the like can be exemplified.

Further, a protective layer containing an ionizing radiation curable resin can be suitably used as the binder for the protective layer, since the plasticizer resistance and the abrasion resistance properties thereof is particularly excellent. There is no particular limitation with respect to the ionizing radiation curable resin, and thus it can be suitably selected from among the ionizing radiation curable resins known in the art, and, for instance, it is possible to use the one in which a radically polymerizable polymer or oligomer is cross-linked and cured by irradiation of ionizing radiation, and optionally polimerized and cross-linked by electron beam or ultraviolet light with using a photo-polymerization initiator additively. A protective layer containing a UV absorbing resin is excellent in giving light resistance to the printed matter.

As the ultraviolet-absorbing resin, for instance, a resin which is prepared by reacting and linking an reactive ultraviolet-absorbing agent to a thermoplastic resin or an ionizing radiation curable resin mentioned above can be used. More concretely, those which prepared by introducing a reactive group such as an addition-polymerizable double bond (for instance, vinyl group, acryloyl group, methacryloyl group, etc.), alcoholic hydroxyl group, amino group, carboxyl group, epoxy group, isocyanate group, etc., into a non-reactive organic ultraviolet absorbing agent known in the art such as salicylate series, benzophenon series, benzotriazole series, substituted acrylonitrile series, nikkel-chelate series, hindered amine series, etc., can be exemplified.

Further, if necessary, it is also possible to add any additive, for example, lubricants, plasticizers, fillers, antistatic agents, anti-blocking agents, cross-linking agents, antioxidants, UV absorbers, light stabilizers, colorants such as dyes and pigments, etc. As the method for forming the protective layer, such a procedure as described for the protective layer 4 in the first aspect of the present invention, a procedure as described for the protective layer 40 in the second aspect of the present invention, or a procedure in which one or more members selected from the resin materials exemplified as above is dissolved or dispersed in an appropriate solvent in order to prepare a coating liquid for protective layer, and the coating liquid thus prepared is coated on the substrate 1, or on the exfoliate layer 3 which is optionally provided on the substrate 1, in accordance with a known procedure such as gravure printing method, screen printing method, or reverse-coating method using a gravure plate, etc., and then the coated film is dried, may be applicable. Although there is no particular limitation on the thickness of the protective layer 4, the protective layer 4 is usually about 0.1-50 μm in thickness after drying, and preferably, about 1-20 μm in thickness after drying.

(Receiving Layer)

On the protective layer, a receiving layer 50 which constitutes the transfer layer 2 is provided. On this receiving layer 50, an image will be formed by thermal transfer from a thermal transfer sheet having a coloring agent layer in accordance with the thermal transfer method. Then, the transfer layer 2 of the intermediate transfer medium, on which the image have been thus formed, is transferred onto a transcription receiving article. As a result, a printed matter is produced. Therefore, as a material for forming the receiving layer 50, it is possible to use a resin material which possesses a high adhesiveness to transcription receiving article (hereinafter, it is also referred to as "adhesiveness" occasionally.) and which can easily receive thermally-transferable colorants such as subliming dyes or thermally-fusible inks.

Although there is no particular limitation on the resin material which is included in the receiving layer 50, however, in the present invention, for instance, polyolefin resins such as polypropylene; halogenated resins such as vinyl chloride-vinyl acetate copolymer, ethylene-vinyl acetate copolymer and polyvinylidene chloride; polyvinyl acetate; polyester resins such as polyacrylic ester; polystyrene resins; polyamide resins; copolymer type resins of an olefin such as ethylene or propylene and another vinyl monomer; ionomer or cellulose-based resins such as cellulose diastase; polycarbonate; etc., are exemplified. Among these resin materials, polyester resin and vinyl chloride-vinyl acetate copolymer and a mixture thereof are particularly preferred.

The receiving layer 50 contains a side-chain type aralkyl-modified silicone. The side-chain type aralkyl-modified silicone acts as a release agent, and thus performs an excellent releasing property. Therefore, according to the present invention in which the receiving layer contains the side chain type aralkyl-modified silicone, it is possible to prevent fusion between the thermal transfer sheet having a coloring agent layer and the receiving layer 50 of the intermediate transfer medium at the time of image formation.

In general, the more the content of the substance that acts as a release agent, the less adhesion between the receptor layer and the transferred object is produced at the same temperature. In order to improve the adhesiveness, it is necessary to raise the temperature at the time of transfer. However, the problems such as deformation of the transcription receiving article occur as the temperature at the time of transfer becomes higher. When the side-chain type aralkyl-modified silicone which is contained in the receiving layer 50 of the present invention is in a proportion of from 0.5 to 5% by weight on a base of the total weight of the receiving layer 50, namely, the total weight of the total weight of resin materials and the total weight of the release agent, it can perform an excellent releasing property. Therefore, according to the intermediate transfer medium 10 of the present invention, it is possible to reduce the content of the release agent to be contained in the receiving layer 50 significantly, as compared with the cases in the prior art. Thus, the intermediate transfer medium 10 of the present invention can transfer the transfer layer 2 which includes the receiving layer to the transcription receiving article, even at the temperature that cannot cause the deformation of the transcription receiving article, for instance, at a temperature of about 155° C.

Further, even if the content of the side-chain type aralkyl-modified silicone exceeds to 5% by weight, a further improvement on the releasing property against the thermal transfer sheet cannot be expected, while the adhesiveness to the transcription receiving article is gradually degraded. Therefore, in the receiving layer 50 of the present invention, the side-chain type aralkyl-modified silicone are contained in a proportion of from 0.5 to 5% by weight on a base of the total weight of the receiving layer 50.

Although the side-chain type aralkyl-modified silicone described above are excellent in the release property, it is more preferable to contain also a side-chain type epoxy-modified silicone which plays as a release agent in the receiving layer 50 when focusing on the point that the release property of the layer 50 should be further improved. Although the adhesiveness the side-chain type epoxy-modified silicone is inferior to the side-chain type aralkyl-modified silicone in the adhesiveness, the adhesiveness the side-chain type epoxy-modified silicone is greatly superior to the side-chain type aralkyl-modified silicone in the releasing property. Therefore, when using in combination of the side-chain type aralkyl-modified silicone that has an excellent adhesiveness as well as a good releasing property and the side-chain type epoxy-modified silicone that has an excellent releasing property as well as a good adhesiveness, it becomes possible to provide an intermediate transfer medium which is excellent in both adhesiveness and releasing property.

Further, it is preferable that the side-chain type epoxy-modified silicone is contained in a proportion of from 0.5 to 5% by weight on a base of the total weight of the receiving layer. When the content of the side-chain type epoxy-modified silicone is less than 0.5% by weight, a fear that the improvement of the releasing property by incorporating the side-chain type epoxy-modified silicone declines will arise, while when the content of the side-chain type epoxy-modified silicone is more than 5% by weight, a fear that the adhesiveness declines will arise since the content of the releasing agent comes to be increased.

In addition, when the receiving layer 50 contains the side-chain type aralkyl-modified silicone and the side-chain type epoxy-modified silicone, it is preferable that these components satisfy their respective content ranges as above mentioned, and the total of these component, that is, the total weight of the side-chain type aralkyl-modified silicone and the side-chain type epoxy-modified silicone is in the range of 1 to 5% by weight on a base of the total weight of the receiving layer 50.

By incorporating the side-chain type aralkyl-modified silicone and the side-chain type epoxy-modified silicone within this range in the receiving layer 50, it becomes possible to give particularly excellent releasing property and adhesiveness to the receiving layer 5.

Further, when the mass ratio of the side-chain type aralkyl-modified silicone and the side-chain type epoxy-modified silicone is out of the range of 9:1 to 1:9, i.e., either when having a higher percentage of the side-chain type aralkyl-modified silicone or having a higher percentage of the side-chain type epoxy-modified silicone, it becomes impossible to obtain a further improvement effect in the releasing property in the former case, and becomes degression in the adhesiveness to the transcription receiving article in the latter case. Considering this point, it is preferable that the mass ratio of the side-chain type aralkyl-modified silicone and the side-chain type epoxy-modified silicone is in the range of 9:1 to 1:9.

As described above, the intermediate transfer medium according to the third aspect of the present invention requires to contain the side-chain type aralkyl-modified silicone in the receiving layer 50 as an essential constitution, and preferably, it takes a constitution of further containing the side-chain type epoxy-modified silicone. These constitutions, however, are not intended to prohibit the receiving layer from containing an additional release agent other than the side-chain type aralkyl-modified silicone and the side-chain type epoxy-modified silicone. That is, it is possible that the receiving layer may contains optionally and appropriately a material which serves as a release agent, in addition to the side-chain type aralkyl-modified silicone and the side-chain type epoxy-modified silicone.

The receiving layer 50 can be formed by dissolving or dispersing a resin material or plural resin materials selected from the materials mentioned above as exemplifications, and the side-chain type aralkyl-modified silicone as mentioned above, and optionally the side-chain type epoxy-modified silicone or other release agents, into an appropriate solvent such as water or an organic solvent in order to prepare a coating liquid for the receiving layer, coating thus prepared coating liquid for the receiving layer in accordance with a known procedure such as gravure printing method, screen printing method, or reverse-coating method using a gravure plate, etc., and then drying the coated film, the coating is formed, and then dried. The receiving layer 50 is usually about 1-10 μm in thickness in dried state, although there is no particular limitation in the thickness of the receiving layer 50.

When the receiving layer 50 is transferred to the transcription receiving article via an adhesive layer, adhesiveness for the receiving layer 50 itself is not necessarily required. However, if the receiving layer 50 is transferred to the transcription receiving article without the adhesive layer, it is preferable that the receiving layer 50 comprises a resin material having adhesive property, such as a vinyl chloride-vinyl acetate copolymer. In addition, in the case of not using a resin material which has adhesiveness, it is preferable to provide a primer layer mentioned below.

The receiving layer 50 can be formed by dissolving or dispersing a material or plural materials selected from the above-mentioned materials, and optionally in combination with various additives, into an appropriate solvent such as water or an organic solvent in order to prepare a coating liquid for the receiving layer, coating thus prepared coating liquid for the receiving layer in accordance with a known procedure such as gravure printing method, screen printing method, or reverse-coating method using a gravure plate, etc., and then drying the coated film.

(Primer Layer)

Further, in order to improve the adhesion between the protective layer and the receiving layer 50, a primer layer (not shown in Figs.) may be formed between the protective layer and the receiving layer 50. As the primer layer, for instance, any of polyurethane resins, polyester resins, polyamide resins, epoxy resins, phenolic resins, polyvinyl chloride resins, polyvinyl acetate resins, vinyl chloride-vinyl acetate copolymers, acid-modified polyolefin resins, copolymers of ethylene and comonomer such as vinyl acetate and acrylic acid, (meth)acrylic resins, polyvinyl alcohol resins, polyvinyl acetal resins, polybutadiene resins, and rubber compounds can be used. Particularly, the ones that have oxygen or nitrogen, the ones that are reactive to isocyanate compound, for example, the materials known as adhesive agent such as acrylic resins, urethane resins, amide resins, epoxy resins, ionomer resins, rubber type resins, etc., may be preferably used. In addition, it is preferable that the primer layer contains a filler such as micro-silica, polyethylene wax, etc. This primer layer may be present in the above-described first aspect and second aspect of the present invention as being provided between the receiving layer and the protective layer as is in this aspect.

(Transcription Receiving Article)

Onto the transcription receiving article, the transfer layer 2 of the above-mentioned intermediate transfer medium, in which the thermal transfer image has been formed, is transferred. As a result, it is possible to obtain a printed matter which excels in various durability. As the transcription receiving article to which the intermediate transfer medium according to the present invention can be applied, there is no particular limitation, and for instance, any of vinyl chloride-vinyl acetate copolymer, polyethylene terephthalate (PET), polycarbonate, natural fiber paper, coated paper, tracing paper, glass, metal, ceramics, wood, cloth, and so on, may be utilized. Particularly, with respect to the intermediate transfer medium according to the third aspect of the present invention, it is possible to transfer the transfer layer to the transcription receiving article at about 155° C., a combination of the intermediate transfer medium with a transcription receiving article which is made of a material which cannot deform at a temperature of not more than 155° C. is particularly preferable to be used.

Fourth Aspect of the Present Invention

Figure 2:
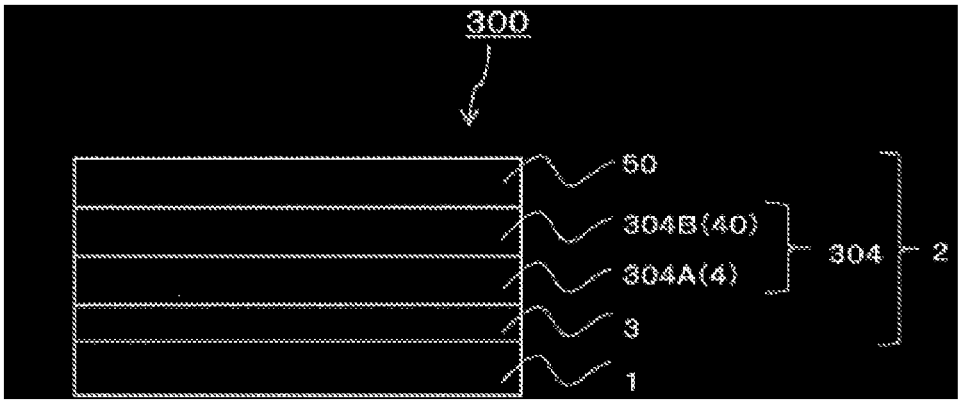
FIG. 2 is a schematic sectional view which illustrate a layered construction of the intermediate transfer medium according to the present invention.

Next, the intermediate transfer medium 300 according to the fourth aspect of the present invention will be described. As shown in FIG. 2, the intermediate transfer medium 300 according to the fourth aspect of the present invention comprises a substrate 1, protective layers 304 having a layered structure of two or more layers, and a receiving layer 50, wherein these are layered in that order, and which is characterized in that one protective layer 304B in the protective layers 304 having the layered structure is a durable layer which mainly comprises one member or a mixture of two or more members selected from the group consisting of polyester of high polymerization degree which has a number average molecular weight (Mn) of not less than 12,000 and Tg of not lower than 60° C., polycarbonate, and polyester urethane; another protective layer 304A in the protective layers 304 having the layered structure is a plasticizer-resistive layer which comprises one or more members selected from the group consisting of polyvinyl alcohol, polyvinyl butyral, polyvinyl acetal, polyvinyl pyrrolidone, or comprises a cationic resin; and the receiving layer 50 contains a side-chain type aralkyl-modified silicone in a proportion of from 0.5 to 5% by weight on a base of the total weight of the receiving layer.

(Substrate)

As the substrate 1 which constitutes the intermediate transfer medium 300, the one that is described above in relation with the first aspect of the present invention can be used as-is, and thus, the explanation thereof is omitted here.

(Protective Layer)

In the fourth aspect of the present invention, the intermediate transfer medium has the protective layers 304 having the layered structure of two or more layers. In an embodiment, one protective layer 304B in the protective layers 304 having the layered structure is a durable layer which mainly comprises one member or a mixture of two or more members selected from the group consisting of polyester of high polymerization degree which has a number average molecular weight (Mn) of not less than 12,000 and Tg of not lower than 60° C., polycarbonate, and polyester urethane, and another protective layer 304A in the protective layers 304 having the layered structure is a plasticizer-resistive layer which comprises one or more members selected from the group consisting of polyvinyl alcohol, polyvinyl butyral, polyvinyl acetal, polyvinyl pyrrolidone, or comprises a cationic resin (Plasticizer-Resistive Layer)

As the plasticizer-resistive layer 304A which constitutes one layer of the protective layers 304 having the layered structure, the protective layer 4 that is described above in relation with the intermediate transfer medium 10 according to the first aspect of the present invention can be used as-is, and thus, the explanation thereof is omitted here. In the fourth aspect of the present invention, because of the presence of the plasticizer-resistive layer 304A which constitutes the protective layers 304, it is possible to provide an excellent plasticizer resistance to a printed matter when the protective layers 304 is transferred thereto.

(Durable Layer)

On the other hand, as the durable layer 304B which constitutes one layer other than the above-mentioned layer of the protective layers 304 having the layered structure, the protective layer 40 that is described above in relation with the intermediate transfer medium 100 according to the second aspect of the present invention can be used as-is, and thus, the explanation thereof is omitted here. In the fourth aspect of the present invention, because of the presence of the durable layer 304B which constitutes the protective layers 304, it is possible to provide an excellent durability to a printed matter when the protective layers 304 is transferred thereto.

The protective layers 304 may be a two layers' structure wherein the plasticizer-resistive layer 304A and the durable layer 304 are layered, alternatively, the protective layers 304 may be a three or more layers' structure wherein any optional layer(s) is included in addition to the plasticizer-resistive layer 304A and the durable layer 304. In the case that the protective layers 304 take a three or more layers' structure, the plasticizer-resistive layer 304A and the durable layer 304 may be layered directly, or the plasticizer-resistive layer 304A and the durable layer 304B may be layered indirectly via the other optional layer(s). Further, the layer which is located closest to the substrate 1 in the protective layers 304 may be any one of the plasticizer-resistive layer 304A, the durable layer 304B, and the other optional protective layer (s). As the protective layer(s) which can be optionally used, the protective layer(s) known in the art as described in relation with the third aspect of the present invention may be used as-is.

Figure 3:
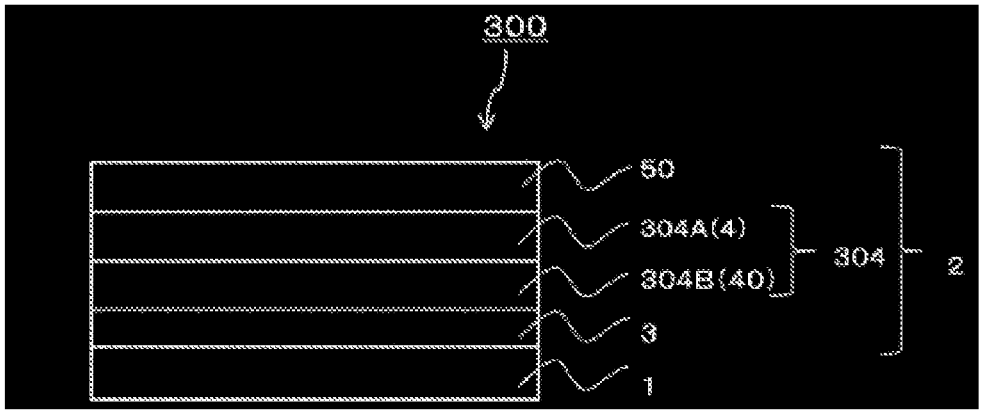
FIG. 3 is a schematic sectional view which illustrate a layered construction of the intermediate transfer medium according to the present invention.

There is also no particular limitation on the positional relationship between the plasticizer-resistive layer 304A and the durable layer 304. As shown in FIG. 2, the plasticizer-resistive layer 304A and the durable layer 304B may be layered in this order from the side of the substrate 1. Alternatively, as shown in FIG. 3, the durable layer 304B and the plasticizer-resistive layer 304A may be layered in this order from the side of the substrate 1. Even in either case, it is possible to impart an excellent plasticizer resistance and an excellent durability to the printed matter to which the protective layer 304 having the layered structure has been transferred.

In addition, when an optional exfoliate layer 3 is provided on the substrate 3 and a plasticizer-resistive layer is formed on this exfoliate layer 3, wherein the plasticizer-resistive layer is formed by using an aqueous coating liquid as mentioned above, it is possible to prevent the phenomenon that the resin which constitutes the plasticizer-resistive layer penetrates through the exfoliate layer 3 and reaches the substrate 1. Namely, by the plasticizer-resistive layer which is formed by using the aqueous coating liquid, the degression of the exfoliation ability when the exfoliate layer 3 is provided between the substrate 1 and the plasticizer-resistive layer can be repressed. Further, since the plasticizer-resistive layer also excels in the solvent resistance as mentioned above, even when the durable layer is formed on the plasticizer-resistive layer, it is possible to repress the penetration of the resin which constitutes the durable layer by the plasticizer-resistive layer. Therefore, in the present invention, it is possible to exemplify as an preferable embodiment the construction where an optional exfoliate layer 3, a plasticizer-resistive layer formed by using an aqueous coating liquid, and a durable layer are layered in this order on the substrate 1.

As shown in FIGS. 2 and 3, it is preferable to provide an exfoliate layer 3 between the substrate 1 and the protective layers 304 in order to improve the exfoliation capability of the protective layers 304 upon the thermal transfer. As the exfoliate layer 3, the one that is described above in relation with the intermediate transfer medium according to the first aspect of the present invention can be used as-is, and thus, the explanation thereof is omitted here.

Herein, in the case that the layer located closest to the substrate 1 among the layers which constitutes the protective layers 304 is the durable layer 304B and the durable layers contains mainly polycarbonate, the protective layers 304 can be easily peeled off from the substrate 1 even if the intermediate transfer medium does not have the exfoliate layer 3, because the polycarbonate excels in the releasing ability to the substrate 1. In this case, it is also possible to be provided with a release layer 3 in order to improve further the exfoliation capability.

(Receiving Layer)

As the receiving layer 50 which constitutes the intermediate transfer medium 300, the receiving layer 50 as described in relation with the intermediate transfer medium 200 according to the third aspect of the present invention can be used as-is, and thus, the explanation thereof is omitted here. Incidentally, in the fourth aspect of the present invention, because of the presence of the receiving layer 50, an excellent releasing property from the thermal transfer sheet and an excellent adhesiveness to the transcription receiving article are given to the intermediate transfer medium 300.

According to the fourth aspect of the present invention described above, it is possible to obtain an printed matter that possesses a high plasticizer resistance and a high durability with ease, and also possible to improve the exfoliation capability from the thermal transfer sheet and the adhesiveness to the transcription receiving layer.

EXAMPLES

Next, the present invention will be described more concretely with demonstrating examples and comparative examples. Hereinafter, unless otherwise specified, the expressions of "part(s)" and "%" means those by weight.

Example 1

Using a PET film of 12 μm in thickness as a substrate, and coating a coating liquid for exfoliate layer having the following composition onto one side of the substrate in accordance with the bar coating method so as to obtain a film thickness of 0.8 μm after drying, and then drying, an exfoliate layer was formed. After that, coating a coating liquid for protective layer 1 having the following composition onto thus formed exfoliate layer in accordance with the bar coating method so as to obtain a film thickness of 1.0 μm after drying, and then drying, a protective layer was formed. Next, coating a coating liquid for receiving layer 1 having the following composition onto thus formed protective layer in accordance with the bar coating method so as to obtain a film thickness of 2.5 μm after drying, and then drying, a receiving layer was formed. Ultimately, the intermediate transfer medium of Example 1 was prepared.

<Coating Liquid for Exfoliate Layer>

| | |
|---|---|
| acrylic resin (BR-87, manufactured by Mitsubishi Rayon Co., Ltd.) | 100 parts |
| toluene | 200 parts |
| MEK | 200 parts |

<Coating Liquid for Protective Layer 1>

| | |
|---|---|
| Polyvinyl alcohol (PVA-210, saponification degree: 88.0%, manufactured by Kuraray Co., Ltd.) | 10 parts |
| water | 45 parts |
| IPA | 45 parts |

<Coating Liquid for Receiving Layer 1>

| | |
|---|---|
| vinyl chloride - vinyl acetate copolymer (Solbin (registered trademark) CNL, manufactured by Nissin Chemical Industry Co., Ltd.) | 95 parts |
| epoxy modified silicone oil (KP-1800U, manufactured by Shin-Etsu Chemical Co., Ltd.) | 5 parts |
| toluene | 200 parts |
| MEK | 200 parts |

Example 2

The same procedure as described in Example 1 was repeated, except for replacing the coating liquid for protective layer 1 with a coating liquid for protective layer 2 having the following composition, in order to prepare an intermediate transfer medium of Example 2.

<Coating Liquid for Protective Layer 2>

| | |
|---|---|
| Polyvinyl butyral (BM-5, saponification degree: 34.0%, manufactured by Sekisui Chemical Co., Ltd.) | 10 parts |
| MEK | 45 parts |
| toluene | 45 parts |

Example 3

The same procedure as described in Example 1 was repeated, except for replacing the coating liquid for protective layer 1 with a coating liquid for protective layer 3 having the following composition, in order to prepare an intermediate transfer medium of Example 3.

<Coating Liquid for Protective Layer 3>

| | |
|---|---|
| Polyvinyl acetal (KX-1, saponification degree: 70.0-90.0%, manufactured by Sekisui Chemical Co., Ltd.) | 50 parts |
| water | 25 parts |
| IPA | 25 parts |

Example 4

The same procedure as described in Example 1 was repeated, except for replacing the coating liquid for protective layer 1 with a coating liquid for protective layer 4 having the following composition, in order to prepare an intermediate transfer medium of Example 4.

<Coating Liquid for Protective Layer 4>

| | |
|---|---|
| polyvinyl pyrrolidone (K-90, manufactured by ISP Japan Ltd.) | 10 parts |
| water | 45 parts |
| ethanol | 45 parts |

Example 5

The same procedure as described in Example 1 was repeated, except for replacing the coating liquid for protective layer 1 with a coating liquid for protective layer 5 having the following composition, in order to prepare an intermediate transfer medium of Example 5.

<Coating Liquid for Protective Layer 5>

| | |
|---|---|
| Polyvinyl acetal (KX-1, saponification degree: 70.0-90.0%, manufactured by Sekisui Chemical Co., Ltd.) | 25 parts |
| polyvinyl pyrrolidone (K-90, manufactured by ISP Japan Ltd.) | 5 parts |
| water | 30 parts |
| IPA | 20 parts |
| ethanol | 20 parts |

Example 6

The same procedure as described in Example 1 was repeated, except for replacing the coating liquid for protective layer 1 with a coating liquid for protective layer 6 having the following composition, in order to prepare an intermediate transfer medium of Example 6.

<Coating Liquid for Protective Layer 6>

| | |
|---|---|
| Polyvinyl alcohol (PVA-103, saponification degree: 98.5%, manufactured by Kuraray Co., Ltd.) | 10 parts |
| water | 45 parts |
| IPA | 45 parts |

Example 7

The same procedure as described in Example 1 was repeated, except for replacing the coating liquid for protective layer 1 with a coating liquid for protective layer 7 having the following composition, in order to prepare an intermediate transfer medium of Example 7.

<Coating Liquid for Protective Layer 7>

| | |
|---|---|
| Polyvinyl alcohol (PVA-403, saponification degree: 80.0%, manufactured by Kuraray Co., Ltd.) | 10 parts |

-continued

| | |
|---|---|
| water | 45 parts |
| IPA | 45 parts |

Example 8

The same procedure as described in Example 1 was repeated, except for replacing the coating liquid for protective layer 1 with a coating liquid for protective layer 8 having the following composition, in order to prepare an intermediate transfer medium of Example 8.

<Coating Liquid for Protective Layer 8>

| | |
|---|---|
| cationic urethane emulsion (SF-600, manufactured by Dai-ichi Kogyo Seiyaku Co., Ltd.) | 10 parts |
| water | 45 parts |
| IPA | 45 parts |

Example 9

The same procedure as described in Example 1 was repeated, except for replacing the coating liquid for protective layer 1 with a coating liquid for protective layer 9 having the following composition, in order to prepare an intermediate transfer medium of Example 9.

<Coating Liquid for Protective Layer 9>

| | |
|---|---|
| cationic urethane emulsion (SF-650, manufactured by Dai-ichi Kogyo Seiyaku Co., Ltd.) | 10 parts |
| water | 45 parts |
| IPA | 45 parts |

Comparative Example 1

The same procedure as described in Example 1 was repeated, except for replacing the coating liquid for protective layer 1 with a coating liquid for protective layer 10 having the following composition, in order to prepare an intermediate transfer medium of Comparative example 1.

<Coating Liquid for Protective Layer 10>

| | |
|---|---|
| anionic urethane emulsion (SF-170, manufactured by Dai-ichi Kogyo Seiyaku Co., Ltd.) | 50 parts |
| water | 15 parts |
| IPA | 35 parts |

Comparative Example 2

The same procedure as described in Example 1 was repeated, except for replacing the coating liquid for protective layer 1 with a coating liquid for protective layer 11 having the following composition, in order to prepare an intermediate transfer medium of Comparative example 2.

<Coating Liquid for Protective Layer 11>

| | |
|---|---|
| acrylic resin (BR-87, manufactured by Mitsubishi Rayon Co., Ltd.) | 100 parts |

-continued

| | |
|---|---|
| toluene | 200 parts |
| MEK | 200 parts |

(Formation of Image)

Using HDP-600 printer (manufactured by HID), and ink ribbon specialized for the printer, a black solid image was printed onto each individual receiving layer of the intermediate transfer media of Examples 1-9 and Comparative Examples 1 and 2, in order to obtain the intermediate transfer media of Examples 1-9 and Comparative Examples 1 and 2, on each receiving layer of which an image was printed.

(Image Forming Condition)

After printing an image to the receiving layer, the image-formed transfer layer (exfoliate layer, protective layer and receiving layer) of each intermediate transfer medium of Examples 1-9 and Comparative examples 1 and 2 was transferred to a card made of polyvinyl chloride (Manufactured by Dai Nippon Printing Co., Ltd) by using HDP-600 printer (manufactured by HID). Thus, printed matters of Examples 1-9 and Comparative examples 1 and 2 were obtained.

<<Evaluation of Coated Film Stability>>

The obtained printed matters were kept under an environment of 40° C. and 90% RH for 48 hours. The printed matters after the keeping were observed by visually whether any cracks exist or not in the printed matters after the keeping. Evaluation of coated film stability was done under the following evaluation criteria. The evaluation results are shown in Table 1.

<Evaluation Criteria>

○: there is no crack at all.

Δ: there are a few small cracks.

x: there are big fine cracks.

<<Evaluation of Plasticizer Resistance>>

Polyvinyl chloride sheet, ARUTRON (registered trademark) #430 was cut into 5 cm×5 cm in size, and the cut sheets were superposed on the printed matters of Examples 1 to 9 and Comparative Examples 1 and 2, respectively, the superposed materials were kept for 32 hours or 64 hours under an environment of 60° C. while applying a load of 1750 g onto the individual superposed materials. After the time elapsed, the polyvinyl chloride sheets were peeled off from the printed maters of Examples 1-9 and Comparative Examples 1 and 2, respectively, and the polyvinyl chloride sheets were observed by visually whether the image of the printed matter migrated to the polyvinyl chloride sheet or not. Evaluation of plasticizer resistance was done under the following evaluation criteria. The evaluation results are shown in Table 1.

<Evaluation Criteria>

○: The image did not migrate from of the printed matter to the vinyl chloride sheet at all.

Δ: Although the image migrated to the vinyl chloride sheet slightly, the image on the colors of printed matter did not fade.

x: The image migrated to the vinyl chloride sheet considerably, and the colors of the image of the printed matter was also faded.

TABLE 1

| | Evaluation of plasticizer resistance | | Evaluation of coated film |
|---|---|---|---|
| | 32 hours | 64 hours | stability |
| Example 1 | ○ | ○ | ○ |
| Example 2 | ○ | Δ | ○ |
| Example 3 | ○ | ○ | ○ |
| Example 4 | ○ | Δ | ○ |
| Example 5 | ○ | ○ | ○ |
| Example 6 | ○ | ○ | ○ |
| Example 7 | ○ | ○ | ○ |
| Example 8 | ○ | Δ | ○ |
| Example 9 | ○ | Δ | ○ |
| Comparative example 1 | x | x | ○ |
| Comparative example 2 | Δ | x | x |

As is apparent from Table 1, it was found that Examples 1-7 of which the protective layer contained one or more members selected from the group consisting of polyvinyl alcohol, polyvinyl butyral, polyvinyl acetal, and polyvinyl pyrrolidoneone, and Examples 8 and 9 of which the protective layer contained the cationic resin shown an excellent plasticizer resistance, as compared with Comparative Examples 1 and 2 of which the protective layer did not contain any of these substances. Further, all of Examples 1 to 9 were also found to have an excellent coated film stability.

Example 10

Using a polyethylene terephthalate film (manufactured by Toray Industries, Inc., Lumirror) of 12 μm in thickness as a substrate, and coating a coating liquid for exfoliate layer having the above-mentioned composition onto one side of the substrate so as to obtain a film thickness of 1.0 μm after drying, and then drying, an exfoliate layer was formed. After that, coating a coating liquid for protective layer 12 having the following composition onto thus formed exfoliate layer so as to obtain a film thickness of 10.0 μm after drying, and then drying, a protective layer was formed. Further, coating a coating liquid for receiving layer 1 having the above-mentioned composition onto thus formed protective layer so as to obtain a film thickness of 2.0 μm after drying, and then drying, a receiving layer was formed. Ultimately, the intermediate transfer medium of Example 10 was prepared. Herein, all the coatings of the coating liquid for exfoliate layer, the coating liquid for protective layer 12, and the coating liquid for receiving layer 1 were performed in accordance with gravure coating.

<Coating Liquid for Protective Layer 12>

| | |
|---|---|
| polyester resin (Vylon 270, manufactured by TOYOBO Co., Ltd., number average molecular weight (Mn): 23000, Tg = 67° C.) | 20 parts |
| toluene | 40 parts |
| MEK | 40 parts |

Example 11

The same procedure as described in Example 10 was repeated, except for replacing the coating liquid for protective layer 12 with a coating liquid for protective layer 13 having the following composition, in order to prepare an intermediate transfer medium of Example 11.

<Coating Liquid for Protective Layer 12>

| | |
|---|---|
| polyester resin (UE-9200, manufactured by UNITIKA, Ltd., number average molecular weight (Mn): 15000, Tg = 65° C.) | 20 parts |
| toluene | 40 parts |
| MEK | 40 parts |

Example 12

The same procedure as described in Example 10 was repeated, except for replacing the coating liquid for protective layer 12 with a coating liquid for protective layer 14 having the following composition, in order to prepare an intermediate transfer medium of Example 12.

<Coating Liquid for Protective Layer 14>

| | |
|---|---|
| polycarbonate resin (FPC-2136, manufactured by Mitsubishi Gas Chemical Company, Inc.) | 20 parts |
| toluene | 40 parts |
| MEK | 40 parts |

Example 13

The same procedure as described in Example 10 was repeated, except for replacing the coating liquid for protective layer 12 with a coating liquid for protective layer 15 having the following composition, in order to prepare an intermediate transfer medium of Example 13.

<Coating Liquid for Protective Layer 15>

| | |
|---|---|
| polyester urethane resin (UR-1350, 33% solution, manufactured by TOYOBO Co., Ltd.) | 60.6 parts |
| toluene | 19.7 parts |
| MEK | 19.7 parts |

Example 14

The same procedure as described in Example 10 was repeated, except for replacing the coating liquid for protective layer 12 with a coating liquid for protective layer 16 having the following composition, in order to prepare an intermediate transfer medium of Example 14.

<Coating Liquid for Protective Layer 16>

| | |
|---|---|
| polyester resin (Vylon 270, manufactured by TOYOBO Co., Ltd., number average molecular weight (Mn): 23000, Tg = 67° C.) | 10 parts |
| polycarbonate resin (FPC-2136, manufactured by Mitsubishi Gas Chemical Company, Inc.) | 10 parts |

-continued

| | |
|---|---|
| toluene | 40 parts |
| MEK | 40 parts |

Example 15

The same procedure as described in Example 10 was repeated, except for replacing the coating liquid for protective layer 12 with a coating liquid for protective layer 17 having the following composition, in order to prepare an intermediate transfer medium of Example 15.

<Coating Liquid for Protective Layer 17>

| | |
|---|---|
| polyester resin (Vylon 270, manufactured by TOYOBO Co., Ltd., number average molecular weight (Mn): 23000, Tg = 67° C.) | 10 parts |
| polyester urethane resin (UR-1350, 33% solution, manufactured by TOYOBO Co., Ltd.) | 30.3 parts |
| toluene | 29.9 parts |
| MEK | 29.9 parts |

Example 16

The same procedure as described in Example 10 was repeated, except that the coating liquid for protective layer 12 was coated so as to obtain a film thickness of 5.0 μm after drying upon the formation of the protective layer, in order to prepare an intermediate transfer medium of Example 16.

Example 17

The same procedure as described in Example 10 was repeated, except that the coating liquid for protective layer 14 was coated so as to obtain a film thickness of 2.5 μm after drying upon the formation of the protective layer, in order to prepare an intermediate transfer medium of Example 17.

Example 18

Onto a polyethylene terephthalate film (manufactured by Toray Industries, Inc., Lumirror) of 12 μm in thickness as a substrate, the above-mentioned coating liquid for protective layer 14 was coated so as to obtain a film thickness of 2.5 μm after drying, thus the film as an exfoliate and protective layer was formed. Further, the coating liquid for receiving layer 1 having the above-mentioned composition was coated onto thus formed the exfoliate and protective layer so as to obtain a film thickness of 2.0 μm after drying, thus a receiving layer was formed. Ultimately, the intermediate transfer medium of Example 18 was prepared. Herein, all the coatings of the coating liquid for the coating liquid for exfoliate and protective layer 14, and the coating liquid for receiving layer 1 were performed in accordance with gravure coating.

Comparative Example 3

The same procedure as described in Example 10 was repeated, except for replacing the coating liquid for protective layer 12 with a coating liquid for protective layer 18 having the following composition, in order to prepare an intermediate transfer medium of Comparative example 3.

<Coating Liquid for Protective Layer 18>

| | |
|---|---|
| acrylic resin (BR-80, manufactured by Mitsubishi Rayon Co., Ltd.) | 20 parts |
| toluene | 40 parts |
| MEK | 40 parts |

Comparative Example 4

The same procedure as described in Example 10 was repeated, except for replacing the coating liquid for protective layer 12 with a coating liquid for protective layer 19 having the following composition, in order to prepare an intermediate transfer medium of Comparative example 4.

<Coating Liquid for Protective Layer 19>

| | |
|---|---|
| polyester resin (GK-780, manufactured by TOYOBO Co., Ltd., number average molecular weight (Mn): 11000, Tg = 38° C.) | 20 parts |
| toluene | 40 parts |
| MEK | 40 parts |

<<Durable Test (Taber Test)>>

Using HDP-600 printer (manufactured by HID), each intermediate transfer medium of Examples 10-18 and Comparative examples 3 and 4 was superposed on a card made of polyvinyl chloride (Manufactured by Dai Nippon Printing Co., Ltd), and the transfer layer (exfoliate layer, protective layer and receiving layer) of each individual intermediate transfer medium was transferred to the card, by using HDP-600 printer (manufactured by HID). Thus, printed matters of 10-18 and Comparative examples 3 and 4 were obtained.

The printed matters underwent wearing wherein an wear ring CS-10F was used under a load of 500 gf and was run for 1500 revolutions in total while the wear ring was grinded per 250 revolutions. After wearing, the conditions of the surfaces were observed by visually, and evaluation of this test was done under the following evaluation criteria. The evaluation test results are shown in table 2.

<Evaluation Criteria>

○: The printed matter (image) was not removed at all.

Δ: The printed matter (image) was little removed.

x: The printed matter (image) was fairly removed.

<<Blooming (Definition) Test>>

The blooming (definition) of the printed matters of 10-18 and Comparative examples 3 and 4 were observed by visually, and evaluation of this test was done under the following evaluation criteria. The evaluation test results are shown in table 2.

<Evaluation Criteria>

◎: The blooming did not occur (not more than 1 mm)

○: The blooming occurred little (not more than 2 mm)

Δ: The blooming occurred in some degree (about 5 mm)

x: The blooming occurred considerably (not less than 10 mm)

TABLE 2

| | Durable test (Taber test) | Blooming test (definition test) |
|---|---|---|
| Example 10 | ◎ | ◎ |
| Example 11 | ◎ | ◎ |
| Example 12 | ◎ | x |
| Example 13 | ◎ | Δ |
| Example 14 | ◎ | Δ |
| Example 15 | ◎ | ○ |
| Example 16 | ○ | ◎ |
| Example 17 | ○ | ○ |
| Example 18 | ○ | ○ |
| Comparative example 3 | x | x |
| Comparative example 4 | x | ◎ |

As is apparent from Table 1, it was found that all of Examples 10-18 of which the protective layer mainly contained one member or a mixture of two or more members selected from the group consisting of polyester of high polymerization degree which has a number average molecular weight (Mn) of not less than 12,000 and Tg of not lower than 60° C., polycarbonate, and polyester urethane shown an excellent durability, while both of Comparative example 3 in which acrylic resin was used and Comparative example 4 in which polyester having a number average molecular weight (Mn) of less than 12,000 and Tg of lower than 60° C. was used were inferior in durability.

In addition, it was found that the blooming did not occur at all or occurred little with respect to Examples of which the protective layer contained polyester(s) of high polymerization degree which has a number average molecular weight (Mn) of not less than 12,000 and Tg of not lower than 60° C., and thus these could yield excellent evaluations.

Example 19

Using a PET film of 12 μm in thickness as a substrate, and coating a coating liquid for exfoliate layer having the above-mentioned composition onto one side of the substrate in accordance with gravure coating method so as to obtain a film thickness of 1.0 μm after drying, and then drying, an exfoliate layer was formed. After that, coating a coating liquid for protective layer 20 having the following composition onto thus formed exfoliate layer in accordance with gravure coating method so as to obtain a film thickness of 2.0 μm after drying, and then drying, a protective layer was formed. Next, coating a coating liquid for primer layer having the following composition onto thus formed protective layer in accordance with gravure coating method so as to obtain a film thickness of 1.0 μm after drying, and then drying, a primer layer was formed. Further, coating a coating liquid for receiving layer 2 having the following composition onto thus formed primer layer in accordance with gravure coating method so as to obtain a film thickness of 2.5 μm after drying, and then drying, a receiving layer was formed. Ultimately, the intermediate transfer medium of Example 19 was prepared.

<Coating Liquid for Protective Layer 20>

| | |
|---|---|
| styrene - acryl type resin (MUTICLE PP320P, manufactured by Mitsui Chemicals, Inc.) | 150 parts |

-continued

| | |
|---|---|
| polyvinyl alcohol (C-318, manufactured by DNP Fine Chemicals Co., Ltd.) | 100 parts |
| water/ethanol (mass ratio: 1/2) | 70 parts |

<Coating Liquid for Primer Layer>

| | |
|---|---|
| polyester resin (Vylon 200, manufactured by TOYOBO Co., Ltd.) | 33 parts |
| vinyl chloride - vinyl acetate copolymer (CNL, manufactured by Nissin Chemical Industry Co., Ltd.) | 27 parts |
| isocyanate curing agent (XEL curing agent, manufactured by The Intec., co., Ltd.) | 15 parts |
| toluene | 50 parts |
| MEK | 50 parts |

<Coating Liquid for Receiving Layer 2>

| | |
|---|---|
| vinyl chloride - vinyl acetate copolymer (CNL, manufactured by Nissin Chemical Industry Co., Ltd.) | 98 parts |
| side-chain type aralkyl-modified silicone oil (KF-410, manufactured by Shin-Etsu Chemical Co., Ltd.) | 2 parts |
| toluene | 200 parts |
| MEK | 200 parts |

Example 20

The same procedure as described in Example 19 was repeated, except for replacing the coating liquid for receiving layer 2 with a coating liquid for receiving layer 3 having the following composition, in order to prepare an intermediate transfer medium of Example 20.

<Coating Liquid for Receiving Layer 3>

| | |
|---|---|
| vinyl chloride - vinyl acetate copolymer (CNL, manufactured by Nissin Chemical Industry Co., Ltd.) | 95 parts |
| side-chain type aralkyl-modified silicone oil (KF-410, manufactured by Shin-Etsu Chemical Co., Ltd.) | 5 parts |
| toluene | 200 parts |
| MEK | 200 parts |

Example 21

The same procedure as described in Example 19 was repeated, except for replacing the coating liquid for receiving layer 2 with a coating liquid for receiving layer 4 having the following composition, in order to prepare an intermediate transfer medium of Example 21.

<Coating Liquid for Receiving Layer 4>

| | |
|---|---|
| vinyl chloride - vinyl acetate copolymer (CNL, manufactured by Nissin Chemical Industry Co., Ltd.) | 98 parts |
| side-chain type aralkyl-modified silicone oil (KF-410, manufactured by Shin-Etsu Chemical Co., Ltd.) | 1.5 parts |
| side-chain type epoxy-modified silicone oil (KP-1800U, manufactured by Shin-Etsu Chemical Co., Ltd.) | 0.5 parts |
| toluene | 200 parts |
| MEK | 200 parts |

Example 22

The same procedure as described in Example 19 was repeated, except for replacing the coating liquid for receiving layer 2 with a coating liquid for receiving layer 5 having the following composition, in order to prepare an intermediate transfer medium of Example 22.

<Coating Liquid for Receiving Layer 5>

| | |
|---|---|
| vinyl chloride - vinyl acetate copolymer (CNL, manufactured by Nissin Chemical Industry Co., Ltd.) | 98 parts |
| side-chain type aralkyl-modified silicone oil (KF-410, manufactured by Shin-Etsu Chemical Co., Ltd.) | 0.5 parts |
| side-chain type epoxy-modified silicone oil (KP-1800U, manufactured by Shin-Etsu Chemical Co., Ltd.) | 1.5 parts |
| toluene | 200 parts |
| MEK | 200 parts |

Example 23

The same procedure as described in Example 19 was repeated, except for replacing the coating liquid for receiving layer 2 with a coating liquid for receiving layer 6 having the following composition, in order to prepare an intermediate transfer medium of Example 23.

<Coating Liquid for Receiving Layer 6>

| | |
|---|---|
| vinyl chloride - vinyl acetate copolymer (CNL, manufactured by Nissin Chemical Industry Co., Ltd.) | 98 parts |
| side-chain type aralkyl-modified silicone oil (KF-410, manufactured by Shin-Etsu Chemical Co., Ltd.) | 1.5 parts |
| side-chain type epoxy-modified silicone oil (X-22-3000T, manufactured by Shin-Etsu Chemical Co., Ltd.) | 0.5 parts |
| toluene | 200 parts |
| MEK | 200 parts |

Example 24

The same procedure as described in Example 19 was repeated, except for replacing the coating liquid for receiving layer 2 with a coating liquid for receiving layer 7 having the following composition, in order to prepare an intermediate transfer medium of Example 24.

<Coating Liquid for Receiving Layer 7>

| | |
|---|---|
| vinyl chloride - vinyl acetate copolymer (CNL, manufactured by Nissin Chemical Industry Co., Ltd.) | 98 parts |
| side-chain type aralkyl-modified silicone oil (KF-410, manufactured by Shin-Etsu Chemical Co., Ltd.) | 0.5 parts |
| side-chain type epoxy-modified silicone oil (X-22-3000T, manufactured by Shin-Etsu Chemical Co., Ltd.) | 1.5 parts |
| toluene | 200 parts |
| MEK | 200 parts |

-continued

| | |
|---|---|
| toluene | 200 parts |
| MEK | 200 parts |

Example 25

The same procedure as described in Example 19 was repeated, except for replacing the coating liquid for receiving layer 2 with a coating liquid for receiving layer 8 having the following composition, in order to prepare an intermediate transfer medium of Example 25.

<Coating Liquid for Receiving Layer 8>

| | |
|---|---|
| vinyl chloride - vinyl acetate copolymer (CNL, manufactured by Nissin Chemical Industry Co., Ltd.) | 98 parts |
| side-chain type aralkyl-modified silicone oil (X-24-510, manufactured by Shin-Etsu Chemical Co., Ltd.) | 1.5 parts |
| side-chain type epoxy-modified silicone oil (X-22-3000T, manufactured by Shin-Etsu Chemical Co., Ltd.) | 0.5 parts |
| toluene | 200 parts |
| MEK | 200 parts |

Comparative Example 5

The same procedure as described in Example 19 was repeated, except for replacing the coating liquid for receiving layer 2 with a coating liquid for receiving layer 9 having the following composition, in order to prepare an intermediate transfer medium of Comparative example 5.

<Coating Liquid for Receiving Layer 9>

| | |
|---|---|
| vinyl chloride - vinyl acetate copolymer (CNL, manufactured by Nissin Chemical Industry Co., Ltd.) | 200 parts |
| toluene | 200 parts |
| MEK | 200 parts |

Comparative Example 6

The same procedure as described in Example 19 was repeated, except for replacing the coating liquid for receiving layer 2 with a coating liquid for receiving layer 10 having the following composition, in order to prepare an intermediate transfer medium of Comparative example 6.

<Coating Liquid for Receiving Layer 10>

| | |
|---|---|
| vinyl chloride - vinyl acetate copolymer (CNL, manufactured by Nissin Chemical Industry Co., Ltd.) | 98 parts |
| side-chain type epoxy-modified silicone oil (KP-1800U, manufactured by Shin-Etsu Chemical Co., Ltd.) | 2 parts |
| toluene | 200 parts |
| MEK | 200 parts |

Comparative Example 7

The same procedure as described in Example 19 was repeated, except for replacing the coating liquid for receiving layer 2 with a coating liquid for receiving layer 11 having the following composition, in order to prepare an intermediate transfer medium of Comparative example 7.

<Coating Liquid for Receiving Layer 11>

| | |
|---|---|
| vinyl chloride - vinyl acetate copolymer (CNL, manufactured by Nissin Chemical Industry Co., Ltd.) | 98 parts |
| polyether-modified silicone oil (KF-352A, manufactured by Shin-Etsu Chemical Co., Ltd.) | 2 parts |
| toluene | 200 parts |
| MEK | 200 parts |

Comparative Example 8

The same procedure as described in Example 19 was repeated, except for replacing the coating liquid for receiving layer 2 with a coating liquid for receiving layer 12 having the following composition, in order to prepare an intermediate transfer medium of Comparative example 8.

<Coating Liquid for Receiving Layer 12>

| | |
|---|---|
| vinyl chloride - vinyl acetate copolymer (CNL, manufactured by Nissin Chemical Industry Co., Ltd.) | 98 parts |
| amino-polyether-modified silicone oil (X-22-3939A, manufactured by Shin-Etsu Chemical Co., Ltd.) | 2 parts |
| toluene | 200 parts |
| MEK | 200 parts |

Using HDP-600 printer (manufactured by HID), and ink ribbon specialized for the printer, under an environment of 20° C. and 50% RH, evaluations for dye releasing property and for dye re-transferring property to card were performed. Incidentally, the card used for the evaluations was polyvinyl chloride card having the following composition (manufactured by DNP).

(Material Composition of Polyvinyl Chloride Card)

| | |
|---|---|
| Polyvinyl chloride compound (polymerization degree: 800) (containing about 10% of additives such as stabilizer) | 100 parts |
| white pigment (titanium oxide) | 10 parts |
| plasticizer (DOP) | 0.5 part |

<<Evaluation of Dye Releasing Property>>

After a black solid image was printed onto each individual receiving layer of the intermediate transfer media of Examples 19-25 and Comparative Examples 5-8, dye ribbons used were observed whether the receiving layer was taken to the dye layer side and thereby defects in image were caused or not. The evaluation was done under the following evaluation criteria. The evaluation results are shown in Table 3.

<Evaluation Criteria>

◎: No damage was observed in the dye layer, and no defect was observed in the printed matter.

○: Although a little damage was observed in the receiving layer, but no defect was observed in the printed matter.

Δ: Considerable damage was observed in the dye layer, and a few defects were also observed in the printed matter.

x: Fairly considerable damage was observed in the dye layer, and a considerable amount of defects were also observed in the printed matter.

<<Evaluation of Re-Transferring Property>>

After a white solid image was printed onto each individual receiving layer of the intermediate transfer media of Examples 19-25 and Comparative Examples 5-8, the image was re-transferred to the above-mentioned polyvinyl chloride card under the re-transferring condition of 155° C. Evaluation of re-transferring property was done under the following evaluation criteria. The evaluation results are shown in Table 3.

<Evaluation Criteria>

◎: No poor adhesion was observed at all.

○: Substantially no poor adhesion was little observed.

Δ: A considerable degree of poor adhesion was observed.

x: A fairly considerable degree of poor adhesion was observed.

TABLE 3

| | Dye releasing property | Re-transferring property |
|---|---|---|
| Example 19 | ○ | ◎ |
| Example 20 | ◎ | ○ |
| Example 21 | ◎ | ◎ |
| Example 22 | ◎ | ◎ |
| Example 23 | ◎ | ◎ |
| Example 24 | ◎ | ◎ |
| Example 25 | ◎ | ◎ |
| Comparative example 5 | x | ◎ |
| Comparative example 6 | ◎ | x |
| Comparative example 7 | Δ | Δ |
| Comparative example 8 | ◎ | x |

Example 26

Using a PET film of 12 μm in thickness as a substrate, and coating the coating liquid for exfoliate layer having the above-mentioned composition onto one side of the substrate in accordance with the bar coating method so as to obtain a film thickness of 0.8 μm after drying, and then drying, an exfoliate layer was formed. After that, coating the coating liquid for protective layer 6 having the above-mentioned composition onto thus formed exfoliate layer in accordance with the bar coating method so as to obtain a film thickness of 1.0 μm after drying, and then drying, a first protective layer was formed. Next, coating the coating liquid for protective layer 12 having the above-mentioned composition onto thus formed first protective layer in accordance with the bar coating method so as to obtain a film thickness of 10.0 μm after drying, and then drying, a second protective layer was formed. Further, coating the coating liquid for receiving layer 6 having the above-mentioned composition onto thus formed second protective layer so as to obtain a film thickness of 2.5 μm after drying in accordance with gravure coating method, and then drying, a receiving layer was formed. Ultimately, the intermediate transfer medium of Example 26 was prepared.

Example 27

The same procedure as described in Example 26 was repeated, except for replacing the coating liquid for protective layer 6 with the coating liquid for protective layer 9 having the above-mentioned composition with respect to the formation of the first protective layer, in order to prepare an intermediate transfer medium of Example 27.

Example 28

The same procedure as described in Example 26 was repeated, except for replacing the coating liquid for protective layer 6 with the coating liquid for protective layer 9 having the above-mentioned composition with respect to the formation of the first protective layer and replacing the coating liquid for protective layer 12 with the coating liquid for protective layer 14 having the above-mentioned composition with respect to the formation of the second protective layer, in order to prepare an intermediate transfer medium of Example 28.

Example 29

The same procedure as described in Example 26 was repeated, except for replacing the coating liquid for protective layer 6 with the coating liquid for protective layer 9 having the above-mentioned composition with respect to the formation of the first protective layer and replacing the coating liquid for protective layer 12 with the coating liquid for protective layer 16 having the above-mentioned composition with respect to the formation of the second protective layer, in order to prepare an intermediate transfer medium of Example 29.

Example 30

Using a polyethylene terephthalate film (manufactured by Toray Industries, Inc., Lumirror) of 12 μm in thickness as a substrate, and coating the coating liquid for protective layer having the above-mentioned composition onto one side of the substrate so as to obtain a film thickness of 2.5 μm after drying, and then drying, an exfoliate and protective layer was formed. After that, coating the coating liquid for protective layer 9 having the above-mentioned composition onto thus formed exfoliate and protective layer so as to obtain a film thickness of 1.0 μm after drying, and then drying, a protective layer was formed. Next, coating the coating liquid for receiving layer 6 having the above-mentioned composition onto thus formed protective layer so as to obtain a film thickness of 2.0 μm after drying, and then drying, a receiving layer was formed. Ultimately, the intermediate transfer medium of Example 30 was prepared. Herein, all the coatings of the coating liquid for the coating liquid for exfoliate and protective layer 14, the coating liquid for protective layer 9 and the coating liquid for receiving layer 6 were performed in accordance with gravure coating.

Example 31

The same procedure as described in Example 26 was repeated, except for replacing the coating liquid for protective layer 6 with the coating liquid for protective layer 12 having the above-mentioned composition with respect to the formation of the first protective layer and replacing the coating liquid for protective layer 12 with the coating liquid for protective layer 9 having the above-mentioned composition with respect to the formation of the second protective layer, in order to prepare an intermediate transfer medium of Example 31.

Comparative Example 9

The same procedure as described in Example 26 was repeated, except for replacing the coating liquid for protective layer 6 with the coating liquid for protective layer 11 having the above-mentioned composition with respect to the formation of the first protective layer, replacing the coating liquid for protective layer 12 with the coating liquid for protective layer 18 having the above-mentioned composition with respect to the formation of the second protective layer, and replacing the coating liquid for receiving layer 6 with the coating liquid for receiving layer 11 having the above-mentioned composition in order to prepare an intermediate transfer medium of Comparative example 9.

(Formation of Image)

Using HDP-600 printer (manufactured by HID), and ink ribbon specialized for the printer, a black solid image was printed onto each individual receiving layer of the intermediate transfer media of Examples 26-31 and Comparative Example 9, in order to obtain the intermediate transfer media of Examples 26-31 and Comparative Example 9, on each receiving layer of which an image was printed.

(Image Forming Condition)

After printing an image to the receiving layer, the image-formed transfer layer (protective layer and receiving layer) of each intermediate transfer medium of Examples 26-31 and Comparative Example 9 was transferred to a card made of polyvinyl chloride (Manufactured by DNP) by using HDP-600 printer (manufactured by HID). Thus, printed matters of Examples 26-31 and Comparative Example 9 were obtained.

As for printed matters of Examples 26-31 and Comparative Example 9 obtained by the above method, the evaluation of coated film stability, the evaluation of plasticizer resistance, the durable test, the blooming test, the evaluation of dye releasing property, the evaluation of re-transferring test were carried out. The evaluation results are shown in Table 4. Herein, each evaluation and test prosecuted in the same manner as described above individually, and was also performed on the basis of the criteria described above individually.

TABLE 4

| | Evaluation of plasticizer resistance | | Evaluation of coated | Durable test | Blooming test | | Re-transferring |
|---|---|---|---|---|---|---|---|
| | 32 hours | 64 hours | film stability | (Taber test) | (Definition test) | Dye releasing property | property |
| Example 26 | ○ | ○ | ○ | ◎ | ◎ | ◎ | ◎ |
| Example 27 | ○ | ○ | ○ | ◎ | ◎ | ◎ | ◎ |
| Example 28 | ○ | ○ | ○ | ◎ | x | ◎ | ◎ |
| Example 29 | ○ | ○ | ○ | ◎ | ◎ | ◎ | ◎ |
| Example 30 | ○ | ○ | ○ | ○ | Δ | ◎ | ◎ |
| Example 31 | ○ | ○ | ○ | ◎ | ◎ | ◎ | ◎ |
| Comparative example 9 | Δ | x | x | x | x | Δ | Δ |

EXPLANATION OF NUMERALS

1 - - - substrate
2 - - - transfer layer
3 - - - exfoliate layer
4, 40 - - - protective layer
304 - - - protective layers in a layered structure
304A - - - plasticizer-resistive layer
304B - - - durable layer
10, 100, 200, 300 - - - intermediate transfer layer

The invention claimed is:

1. An intermediate transfer medium which comprises a substrate, and at least a protective layer and a receiving layer which are layered in that order on one surface side of the substrate;

wherein the protective layer comprises one or more members selected from the group consisting of polyvinyl alcohol, polyvinyl acetal, and polyvinyl pyrrolidone, or comprises a cationic resin, and wherein the polyvinyl alcohol, and the polyvinyl acetal have a saponification degree in the range of 30-100%.

* * * * *